United States Patent [19]

Ostrem et al.

[11] 3,945,334

[45] Mar. 23, 1976

[54] METHOD OF AND APPARATUS FOR FORMING FOLDS IN A CONTAINER PANEL

[75] Inventors: Obert M. Ostrem, Westmont; Donald F. Kulikowski, Oak Forest, both of Ill.

[73] Assignee: Continental Can Company, Inc., New York, N.Y.

[22] Filed: July 23, 1974

[21] Appl. No.: 490,983

[52] U.S. Cl. ..... 113/121 C; 113/15 A

[51] Int. Cl.[2] ..... B21D 51/26

[58] Field of Search ..... 113/1 F, 1 D, 15 A, 121 A, 113/121 C; 220/90.6, 269, 270, 276; 72/348, 349

[56] References Cited

UNITED STATES PATENTS

| | | | |
|---|---|---|---|
| 3,696,961 | 10/1972 | Holk, Jr. | 220/54 |
| 3,765,352 | 10/1973 | Schubert et al. | 113/121 C |
| 3,819,083 | 6/1974 | Holk, Jr. | 220/54 |
| 3,825,149 | 7/1974 | Brown et al. | 220/54 |
| 3,848,557 | 11/1974 | Holk, Jr. | 113/121 C |
| 3,853,080 | 12/1974 | Zundel | 113/121 C |

*Primary Examiner*—Michael J. Keenan

*Attorney, Agent, or Firm*—Diller, Brown, Ramik & Wight

[57] ABSTRACT

This disclosure relates to the forming of folds in a container panel for the purpose of providing a protective fold both about the periphery of a removable panel segment and about the portion of the container panel from which the removable segment has been removed. The two folds are formed in a continuous operation with first one fold being formed and then the other fold being formed without effecting the rupture of the container panel intermediate the folds along a previously formed line of weakening. A die set is provided for properly supporting the various portions of the container member and for applying pressures on the various panels so as to effect a first folding and then a second folding while supporting that panel of the container member containing the line of weakening so as to prevent rupture thereof along the line of weakening.

20 Claims, 8 Drawing Figures

23
27
26
25
24
13
11
12

28
42
22
35
31
30
36
41
18
40
27
34
26
24
33
38
37
25
13
32
12
11

10
13
17
16
12
22
11
14
20
21
18

METHOD OF AND APPARATUS FOR FORMING FOLDS IN A CONTAINER PANEL

This invention relates in general to new and useful improvements in the formation of easy opening container ends and more particularly to an easy opening container end wherein both the removable segment and the remaining portion of the end panel are provided with a protective fold which overlaps the raw edge which results from the tearing of the removable segment along the weakening line.

This invention particularly relates to the formation of a container end of the easy opening type such as that disclosed in the U.S. Pat. to Albert J. Holk, Jr., No. 3,696,961 granted Oct. 10, 1972. The invention particularly relates to the problem of preventing rupture of the container end alonng the weakening line formed therein while folding the metal of the container end, both in the removable panel segment and in the remaining portion of the end panel so as to effect a double folding of the metal in the manner shown in the Holk, Jr. patent. It is to be understood that the necessary folding operation must be accomplished automatically by means of a suitable die set.

In accordance with this invention, it has been determined that the necessary formation of the twin double folds as required in accordance with the disclosure of this application, it is necessary to properly support that panel containing the line of weakening so as to prevent stressing the panel and thus accidentally rupture the panel along the line of weakening.

It has been found that the panel containing the line of weakening may be best supported if the necessary twin folding operation is accomplished in sequence. By first folding the metal outboard of the weakening line, adequate support can be given to the metal of the can end inwardly of the weakening line so as to prevent twisting of the panel containing the weakening line. After the first fold has been formed, the second fold may be readily formed.

A principal feature of the invention is the provision of a die set which includes suitable supports and suitable pressure members and wherein certain of the supports and pressure members are relatively movable with respect to others and wherein a complete supporting of the end unit may be obtained while at the same time applying the necessary pressure to effect the sequential folding of the metal of the end unit in a continuous operation utilizing a single die set for the final folding.

With the above and other objects in view that will hereinafter appear, the nature of the invention will be more clearly understood by reference to the following detailed description, the appended claims and the several views illustrated in the accompanying drawings:

IN THE DRAWINGS

Figures 1, 2, 3:
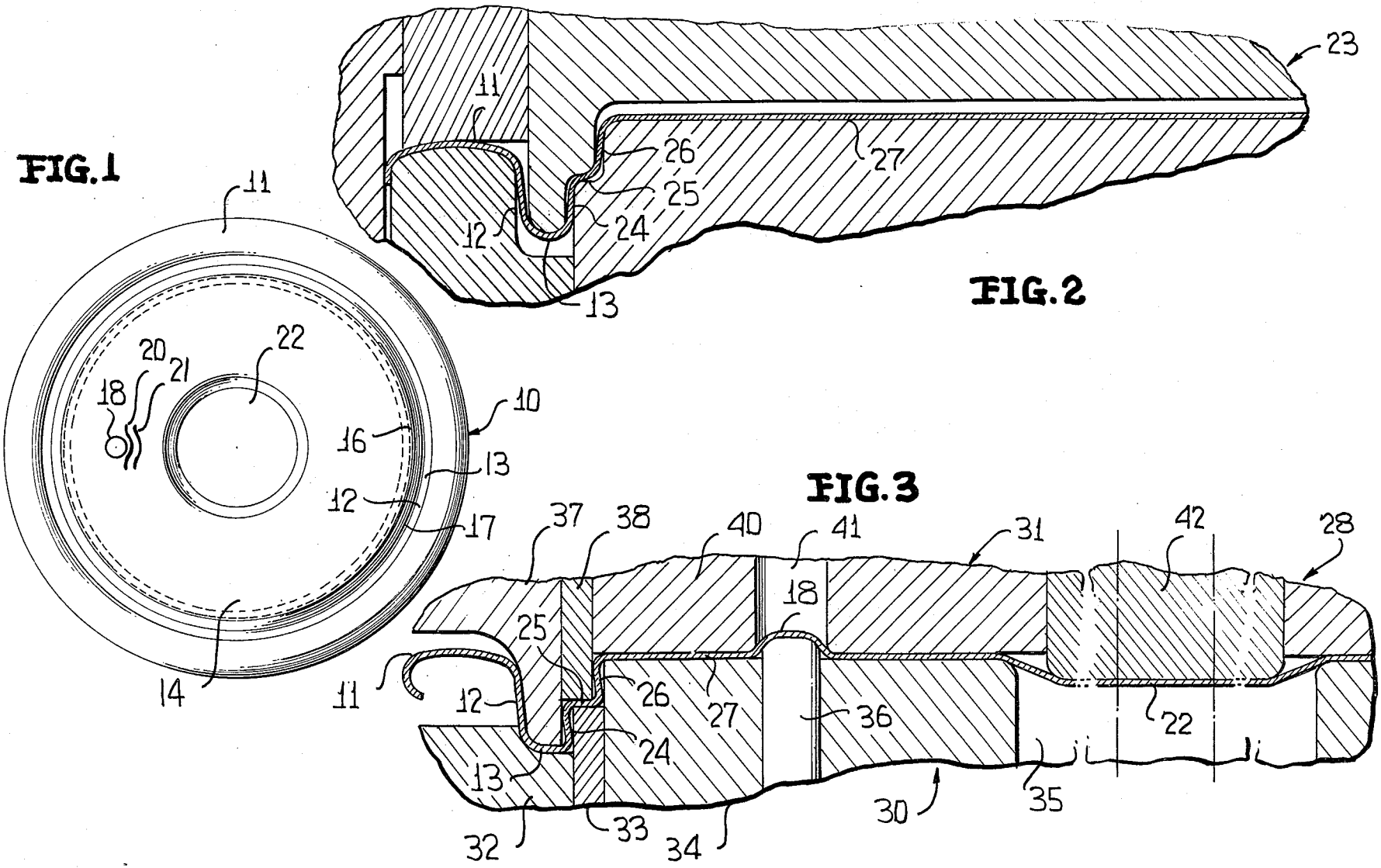
FIG. 1 is a plan view of an end unit formed in accordance with this invention.
FIG. 2 is an enlarged fragmentary vertical sectional view taken through the end unit of FIG. 1 in a first forming operation.
FIG. 3 is a fragmentary sectional view similar to FIG. 2 and shows the details of a second forming operation.
Figures 4, 5, 6, 7, 8:
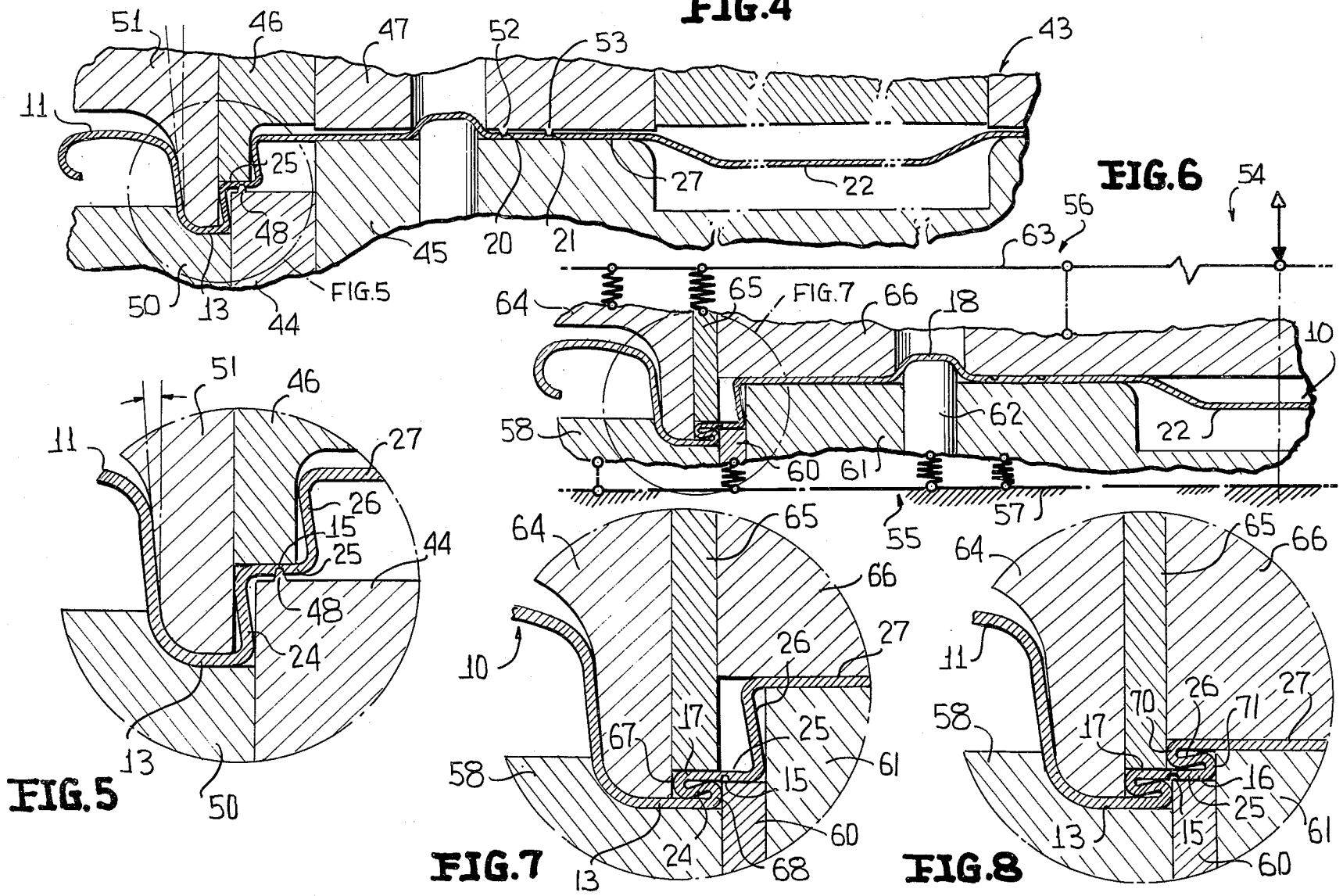
FIG. 4 is another view similar to FIG. 2, but on a smaller scale, showing a third operation.
FIG. 5 is an enlargement of the encircled area of FIG. 4 designated FIG. 5.
FIG. 6 is another view similar to FIG. 2 on a reduced scale showing a fourth operation.
FIG. 7 is an enlargement of that portion of FIG. 6 designated FIG. 8 showing the operation only partially completed.
FIG. 8 is an enlargement like FIG. 7, but showing the details of the completed operation.

Referring now to the drawings, it will be seen that there is illustrated in FIG. 1 an end unit, generally identified by the numeral 10 of the easy opening, full opening type. The end unit 10 includes a peripheral curl 11 of a conventional construction for engagement with the flange of a can body and for combining with such flange to define a conventional double seam. Inwardly of the curl 11 is the usual chuck wall 12 which surrounds an end panel 13. The end panel 13 has formed therein a removable panel portion or segment 14 which is of the full opening type and which is defined by a peripheral weakening line or score 15 (FIG. 8). Formed about the periphery of the removable segment 14 is a double fold 16 and a similar double fold 17 is formed in the end panel 13 about the removable segment 14.

In order to facilitate the opening of the end unit 10 and the removal of the removable segment 14, the removable segment is provided with an integral rivet 18 through which a pull tab (not shown) is attached to the removable segment 14. Adjacent the rivet 18, the removable segment 14 is provided with a conventional type of vent score 20 and associated anti-fracture score 21. Finally, the central portion of the end unit 10 is provided with the usual stiffening offset or recess 22. Referring now to FIG. 2, it will be understood that a can unit blank will initially be drawn by means of a die set, generally identified by the numeral 23, to the configuration shown in FIG. 2 with the curl 11 being partially formed and wherein the end panel 13 is upwardly offset to define in order an outer upstanding panel 24, an intermediate peripheral panel 25, an inner upstanding panel 26 and an inner panel 27.

Following the operation of FIG. 2, in another operation, the inner panel 27 has formed therein a bubble (not shown) from which the rivet 18 is finally formed. Also, the shaping of the curl 11 is completed. Inasmuch as this operation forms no part of this invention, no attempt has been made to illustrate the die set utilized for the method of forming the same.

Referring now to FIG. 3, it will be seen that there is illustrated another die set, generally identified by the numeral 28. The die set 28 includes a lower die unit, generally identified by the numeral 30 and an upper die unit 31. The die unit 31 includes anvils 32,33 and 34 with the anvil 34 having a central opening 35 therein, and additionally, carrying a pin type anvil 36. The die unit 31 includes a pressure member or punch 37 which cooperates with the anvil 32 to shape the chuck wall 12 and to flatten the end panel 13 adjacent the chuck wall 12.

The die unit 31 also includes a pressure member or punch 38 engageable with the intermediate peripheral panel 25 and cooperable with the anvils 32 and 33 to both flatten the intermediate peripheral panel 25 and to reshape the upstanding wall 24 so that the upstanding wall 24 now slopes upwardly and outwardly from the end panel 13 to the intermediate peripheral panel 25.

The die unit 31 also includes a pressure member or punch 40 which in cooperation with the punch 38 and the anvils 33 and 34 re-shape and reposition the inner upstanding panel 26 so that it also slopes upwardly and outwardly.

The punch 40 is provided with an opening 41 which cooperates with the anvil pin 36 to reshape the previously formed bubble (not shown) into the rivet 18. Further, the punch 40 carries a punch 42 which cooperates with the opening 35 in the anvil 34 to form the depression 22.

Reference is now made to FIG. 4 wherein there is illustrated the details of a die set for forming the weakening line or score 15 and the scores 20,21. The die set is generally identified by the numeral 43 and includes anvils 44 and 45 which cooperate with punches or pressure members 46 and 47, respectively, to form these various scores.

It is to be noted that the anvil 44 has an upper surface thereof provided with a scoring projection 48 which opposes that portion of the punch 46 which bears against the intermediate peripheral panel 25. This is best illustrated in FIG. 5. It is to be noted that the intermediate peripheral panel 25 is adequately supported during the formation of the score 15. Further, it is to be noted that the end panel 13 and the inner upstanding panel 24, in addition to the intermediate peripheral panel 25 are adequately supported by an anvil 50 and another pressure member or punch 51 which cooperate with one another and with the anvil 44 and the punch 46.

With respect to the formation of the scores 20,21, it is to be noted that the punch 47 has formed thereon scoring projections 52,53 which engage the upper surface of the inner panel 27, which inner panel is backed up by the anvil 45.

Reference is now made to FIGS. 6, 7 and 8, wherein there are illustrated the details and function of a further die set generally identified by the numeral 54. The function of the die set 54 is to move the intermediate peripheral panel 25 and the inner panel 27 back towards the general plane of the end panel 13 with the resultant folding of the outer upstanding panel 24 into overlying relation with respect to the end panel and the folding of the inner upstanding panel 26 into overlying relation with respect to the intermediate peripheral panel 25. The results of the operation of the die set 54 are best illustrated in FIG. 8.

The die set 54 includes a lower die unit, generally identified by the numeral 55, and an upper die unit, generally identified by the numeral 56. The lower die unit 55 includes a vertically fixed base 57 on which there are mounted anvils 58, 60 and 61. The anvil 58 is fixed relative to the base 57 while the anvils 60 and 61 are resistedly movable towards the base 57. The anvil 61 also carries an upstanding button 62 which is receivable within the rivet 18 so as to assure the proper location of the end unit 10 during the further formation thereof by the die set 54.

The upper die unit 56 includes a head 63 which is vertically movable with respect to the base 57 and which carries pressure members or punches 64, 65 and 66. The punch 66 is fixedly secured to the head 63 for positive movement therewith while the punches 64 and 65 are suitably mounted in a manner not shown for resistive movement towards the head 63 and for movement together with the head 63.

As is clearly shown in FIGS. 7 and 8, the punch 64 cooperates with the anvil 58 to both position the end unit 10 and to clamp the other portion of the end panel 13 in a fixed position. It is to be noted that the anvil 58 extends under the end panel for the full width thereof so as to provide full support for the end panel 13.

The punch 65 is aligned with the inner portion of the anvil 58 for engagement with the intermediate peripheral panel 25 outwardly of the weakening line 15. It is to be noted that at the beginning of the operation utilizing the die set 54, the outer upstanding panel 24 lies fully within a projection of the punch 65.

The anvil 61 is dimensioned to closely fit within the intermediate peripheral panel 25 and to engage the underside of the inner panel 27 in full supporting relation. The anvil 60 is positioned between the anvils 58 and 61 for bearing against the underside of the intermediate peripheral panel 25 generally from the weakening line 15 inwardly and the inner upstanding panel 26 lies fully within the projection of the anvil 60.

After the end panel 13 is clamped between the punch 64 and the anvil 58, further downward movement of the head 63 towards the base 57 results in the punch 65 exerting a downwardly directed pressure on the intermediate peripheral panel 25 and the punch 66 exerting a downward pressure on the inner panel 27. The net result is that the intermediate peripheral panel 25, the inner upstanding panel 26 and the inner panel 27 move downwardly in unison in fully supported relation with the outer upstanding panel 24 being collapsed and the central portion thereof assuming a position clamped between the intermediate peripheral panel 25 and the end panel 13, as is shown in FIG. 7 while the inner upstanding panel 26 remains undeformed. The ends of the displaced panel 24 are in the form of the first bends 67,68 which generally bear radially against the punch 64 and the anvils 60, respectively.

It is to be understood that during the collapsing of the outer upstanding panel 24 to the shape illustrated in FIG. 7, the intermediate peripheral panel 25 is retained at all times in planes disposed substantially parallel to the general plane of the end panel 13 and without the metal thereof being unduly stressed so as to in any way initiate fracture in alignment with the weakening line of the score 15.

After the folding of the outer upstanding panel 24 has been effected to form the outer double fold 17, the continued downward movement of the head 63 results in the continued downward movement of the punch 66 relative to the punches 64,65 with the anvil 61 being forced downwardly while still cooperating with the punch 66 to support the inner panel 27. As a result, the inner upstanding panel 26 is collapsed and folded to the position illustrated in FIG. 8 to form the inner double fold 16. It is to be noted that in the inner double fold 16, the central portion of the inner upstanding panel 26 lies between the intermediate peripheral panel 25 and the inner panel 27 with the ends of the inner upstanding panel 26 defining inner and outer reverse folds 70,71. These folds are positioned by the punch 65 and the anvils 61, respectively.

Inasmuch as the double fold 17 is fully supported by the anvil 58 and the inner portion of the intermediate peripheral panel 25 is fully supported by the anvil 60 during the folding of the inner upstanding panel 26, it will be seen that no undue pressure is exerted upon the intermediate peripheral panel 25 which could possibly initiate fracture thereof in alignment with the weakening line or score 15.

From the foregoing, it will be readily apparent that there has been devised a die set and a method of utilizing the same wherein the necessary double folding of an end panel of a can end on opposite sides of a previously formed weakening or score line may be readily accomplished without unduly distorting the intermediate peripheral panel carrying such score line and without unduly stressing such intermediate peripheral panel so as to produce undesired stresses therein which would result in premature rupturing of the intermediate peripheral panel in alignment with the weakening line.

Although only a preferred embodiment of the invention has been specifically illustrated and described herein, it is to be understood that minor variations may be made in the folding method and the die set utilized therein without departing from the spirit and scope of the invention, as defined by the appended claims.

We claim:

1. A method of forming a container panel with a removable segment defined by a weakening line and with a protective fold in said panel and said removable segment on opposite sides of and adjacent said weakening line, said method comprising the steps of providing a generally planar container panel lying in a first general plane, deforming said panel about a predetermined outline to define an inner panel lying in a second general plane offset from the first general plane, an intermediate peripheral panel lying in a third general plane intermediate the first general plane and the second general plane, an outer upstanding panel joining said intermediate peripheral panel to said container panel, an inner upstanding panel joining said inner panel to said intermediate peripheral panel, and with said weakening line in said intermediate peripheral panel; and then moving said intermediate peripheral panel and said inner panel towards the general plane of said container panel with said inner and outer upstanding panels being sequentially folded to positions at small angles to said general plane of said container panel.

2. The method of claim 1 wherein said folding of said inner and outer upstanding panels is effected in a single continuous operation.

3. The method of claim 1 wherein the general plane of said intermediate peripheral panel is substantially parallel to the first general plane, and said intermediate peripheral panel is maintained substantially parallel to the first general plane during the movement of said intermediate peripheral panel towards said container panel.

4. The method of claim 1 wherein said outer upstanding panel is the first to be folded upstanding panel.

5. The method of claim 4 wherein said intermediate peripheral panel and said inner panel are moved in unison until folding of said outer upstanding panel is completed, and thereafter said inner panel is separately moved to effect said folding of said inner upstanding panel.

6. The method of claim 5 wherein said intermediatperipheral panel is supported during the movement thereof.

7. The method of claim 5 wherein said intermediate peripheral panel and said inner panel are both supported during the movement thereof.

8. The method of claim 7 wherein the supporting of said intermediate peripheral panel and inner panel are separate.

9. The method of claim 5 wherein said movement of said intermediate peripheral panel and said inner panel is effected by forces separately applied thereto.

10. The method of claim 5 wherein said movement of said intermediate peripheral panel and said inner panel is effected by forces separately applied thereto and wherein said intermediate peripheral panel and said inner panel are both supported during the movement thereof.

11. A die set for effecting folding of a container panel having an inner portion thereof deformed to define in sequence an outer upstanding panel, an intermediate peripheral panel offset from the container panel, an inner upstanding panel, and an inner panel offset from both the container panel and the intermediate peripheral panel, said die set comprising a relatively fixed die unit and a cooperating relatively movable die unit; said fixed die unit including a base carrying a first support for a container panel, a second support for an intermediate peripheral panel and a third support for an inner panel; said movable die unit including a head carrying a first pressure member for a container panel, a second pressure member for an intermediate peripheral panel, and a third pressure member for an inner panel.

12. The die set of claim 11 wherein said first and second pressure members are generally aligned with said first support and said third pressure member being generally aligned with said second and third supports.

13. The die set of claim 12 wherein said first support is fixed relative to said base, and said second and third supports are separately movable under pressure towards said base wherein an intermediate peripheral panel and an inner panel may be supported during movement thereof towards an associated container panel seated on said first support.

14. The die set of claim 13 wherein said first and second pressure members are separately movable under pressure towards said head and said third pressure member is fixed relative to said head for positive movement therewith wherein a container panel may be positioned against said first support by said first pressure member and an intermediate peripheral panel and an inner panel may be moved towards the plane of an associated container panel while supported.

15. The die set of claim 12 wherein said first and second pressure members are separately movable under pressure towards said head and said third pressure member is fixed relative to said head for positive movement therewith wherein a container panel may be positioned against said first support by said first pressure member and an intermediate peripheral panel and an inner panel may be moved towards the plane of an associated container panel while supported.

16. The die set of claim 11 wherein said first support is fixed relative to said base, and said second and third supports are separately movable under pressure towards said base wherein an intermediate peripheral panel and an inner panel may be supported during movement thereof towards an associated container panel seated on said first support.

17. The die set of claim 16 wherein said first and second pressure members are separately movable under pressure towards said head and said third pressure member is fixed relative to said head for positive movement therewith wherein a container panel may be positioned against said first support by said first pressure member and an intermediate peripheral panel and an inner panel may be moved towards the plane of an associated container panel while supported.

18. The die set of claim 11 wherein said first and second pressure members are separately movable under pressure towards said head and said third pressure member is fixed relative to said head for positive movement therewith wherein a container panel may be positioned against said first support by said first pressure member and an intermediate peripheral panel and an inner panel may be moved towards the plane of an associated container panel while supported.

19. The die set of claim 11 wherein said second support and said second pressure member are offset relative to one another.

20. The die set of claim 16 wherein the movement of said second support relative to said base is limited and and less than that of said third support for cooperation with said third pressure member to effect folding of an inner upstanding panel therebetween.

* * * * *